US007931485B2

(12) United States Patent
Tseng

(10) Patent No.: US 7,931,485 B2
(45) Date of Patent: Apr. 26, 2011

(54) CONNECTOR WITH SIDE FLANGE

(75) Inventor: Ting-Chang Tseng, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/431,509

(22) Filed: Apr. 28, 2009

(65) Prior Publication Data

US 2009/0269983 A1 Oct. 29, 2009

(30) Foreign Application Priority Data

Apr. 29, 2008 (TW) ..... 97207348 U
Apr. 30, 2008 (CN) ..... 2008 2 0110676

(51) Int. Cl.
*H01R 13/62* (2006.01)

(52) U.S. Cl. ..... 439/306; 439/290; 439/284; 439/607.5

(58) Field of Classification Search ..... 439/607.5, 439/306, 290, 284
See application file for complete search history.

(56) References Cited

U.S. PATENT DOCUMENTS 5,106,326 A * 4/1992 Tsuji et al. ..... 439/596
5,127,852 A * 7/1992 Cravens et al. ..... 439/545
5,957,705 A * 9/1999 David et al. ..... 439/79
6,334,794 B1 * 1/2002 Crane et al. ..... 439/680
6,364,706 B1 * 4/2002 Ando et al. ..... 439/607.37
6,386,888 B1 * 5/2002 Skopic et al. ..... 439/63
6,450,834 B1 * 9/2002 Polgar et al. ..... 439/546
6,773,286 B1 * 8/2004 Wu ..... 439/247
6,890,200 B1 * 5/2005 Wu ..... 439/247
7,018,237 B2 * 3/2006 Zhan et al. ..... 439/607.55
7,081,000 B1 * 7/2006 Senigla ..... 439/306
7,168,978 B1 * 1/2007 Trout et al. ..... 439/545
7,270,570 B1 * 9/2007 Hamner et al. ..... 439/607.04

* cited by examiner

*Primary Examiner* — Truc T Nguyen

(74) *Attorney, Agent, or Firm* — Stephen L. Sheldon

(57) ABSTRACT

An electrical connector comprises an insertion side and a shielding shell. The shielding shell comprises a frame, and further comprises a first mounting portion and a second mounting portion which may be respectively located on two opposing sides of the frame. Each of the first mounting portion and the second mounting portion has a fixing hole, and each has a front surface and a rear surface opposite the front surface. The rear surface of the second mounting portion and the front surface of the first mounting portion are substantially on the same plane.

8 Claims, 9 Drawing Sheets

CONNECTOR WITH SIDE FLANGE

BACKGROUND OF THE INVENTION

1. Related Cases

This application claims priority to Taiwanese Patent Application No 097207348, filed Apr. 29, 2008, and to Chinese Patent Application No 200820110676.6, filed Apr. 30, 2008, both of which are incorporated herein by reference in their entirely.

2. Field of the Invention

The present invention relates to an electrical connector, and more particularly to an electrical connector having a mounting structure with an improved shielding shell.

3. Description of the Related Art

As consumer electronics technologies continue to progress, the market demands electronic appliances to be increasingly integrated into single units that can provide additional functions. In addition, consumers want electronic appliances to have small, lightweight and attractive designs. Therefore, it is beneficial to provide electronic appliances that are compact while still providing interfaces that can provide the additional functions. For example, in FIG. 1, a plurality of socket connectors 8 are arranged in parallel for user access. Each of the socket connectors 8 has an insertion opening for a plug (not shown) to be connected therein. The appliance further comprises an insulating body 81, a plurality of conductive terminals 82 received in the insulating body 81, and a shielding shell 83 covering the insulating body 81. A mounting portion 830 is respectively extended from each of two sides of the insertion opening, and is equipped with a screw hole 831. During assembly, the plurality of socket connectors 8 are mounted on the cover 10 of the electronic appliance through the connection between the screw 9 and screw hole 831. However, the depicted combination of socket connectors 8 takes excessive space and uses more screws 9 for parallel mounting than is desired. Consequently, this combination tends to increase the size and cost of the electronic appliance. In addition, because the mounting portion 830 is a simple sheet-like structure, excessive fastening force can cause the mounting portion 830 to be deformed during assembly, thus reducing the security of the attachment. Consequentially, improvements in the design of the connector would be appreciated.

SUMMARY OF THE INVENTION

The present invention provides an electrical connector which can be stably fixed on an electrical appliance. Particularly, when several connectors of the present invention are disposed side by side, a reduction in space can be realized. This advancement will allow the dimensions of new electrical appliances to continue to become smaller.

The present invention provides an electrical connector comprising an insulation body, a plurality of conductive terminals received in the insulation body, and a shielding shell covering the insulation body. The shielding shell helps define an insertion plane and comprises a frame, and further comprises a first mounting portion and a second mounting portion respectively located on the two sides of the frame. The distance between the first mounting portion and the insertion plane is greater than the distance between the second mounting portion and the insertion plane.

In an embodiment, the frame has two opposite side walls, and further has a top wall and a bottom wall connected to the side walls. The plane of the insertion side is defined by the front ends of the top wall and a bottom wall. The first mounting portion and the second mounting portion are respectively extended from each of front sides of the side walls adjacent to the insertion side, and each of them has a front surface and a rear surface opposite the front surface. Each of the first mounting portion and the second mounting portion has a fixing hole. The rear surface of the fixing hole of the second mounting portion and the front surface of the fixing hole of the first mounting portion are on the same plane. The fixing hole of the first mounting portion further comprises a threaded portion for being easily fixed, which protrudes through to the rear surface of the first mounting portion. The first mounting portion and the second mounting portion further comprise connecting portions extending from the front sides of the side walls to the frame and a base portion extending from the connecting portion. The fixing hole is disposed on the base portion. At least one of the first mounting portion and the second mounting portion further comprises a support foot extending from the rear side of the base portion. The first mounting portion and the second mounting portion further comprise support feet extending from the side edges of the base portions, vertically bent toward their rear and going downwards. A fastening slot forms an upward opening between the base portion of the second mounting portion and its support foot. The bottom edge of the fastening slot is lower than the bottom edge of the connecting portion of the first mounting portion.

The mounting portions disposed on the two sides of the electrical connector of the present invention are at different mounting levels. When the plurality of electrical connectors are disposed together side by side, the mounting portions of the adjacent electrical connectors mutually contact each other in a front-to-rear manner. Therefore, the required mounting space is reduced and manufacturing cost is saved. In addition, the mounting portions of the electrical connector of the present invention have fixing feet which can equally resist forces while being mounted to a printed circuit board. The mounting portions are not easily bent so it achieves a stable fixing objective.

BRIEF DESCRIPTION OF THE DRAWINGS

The invention will be described according to the appended drawings in which.

PREFERRED EMBODIMENT OF THE PRESENT INVENTION

To make the features of the present invention more comprehensible, the present invention is further illustrated below through its preferred embodiments.

Figure 1:
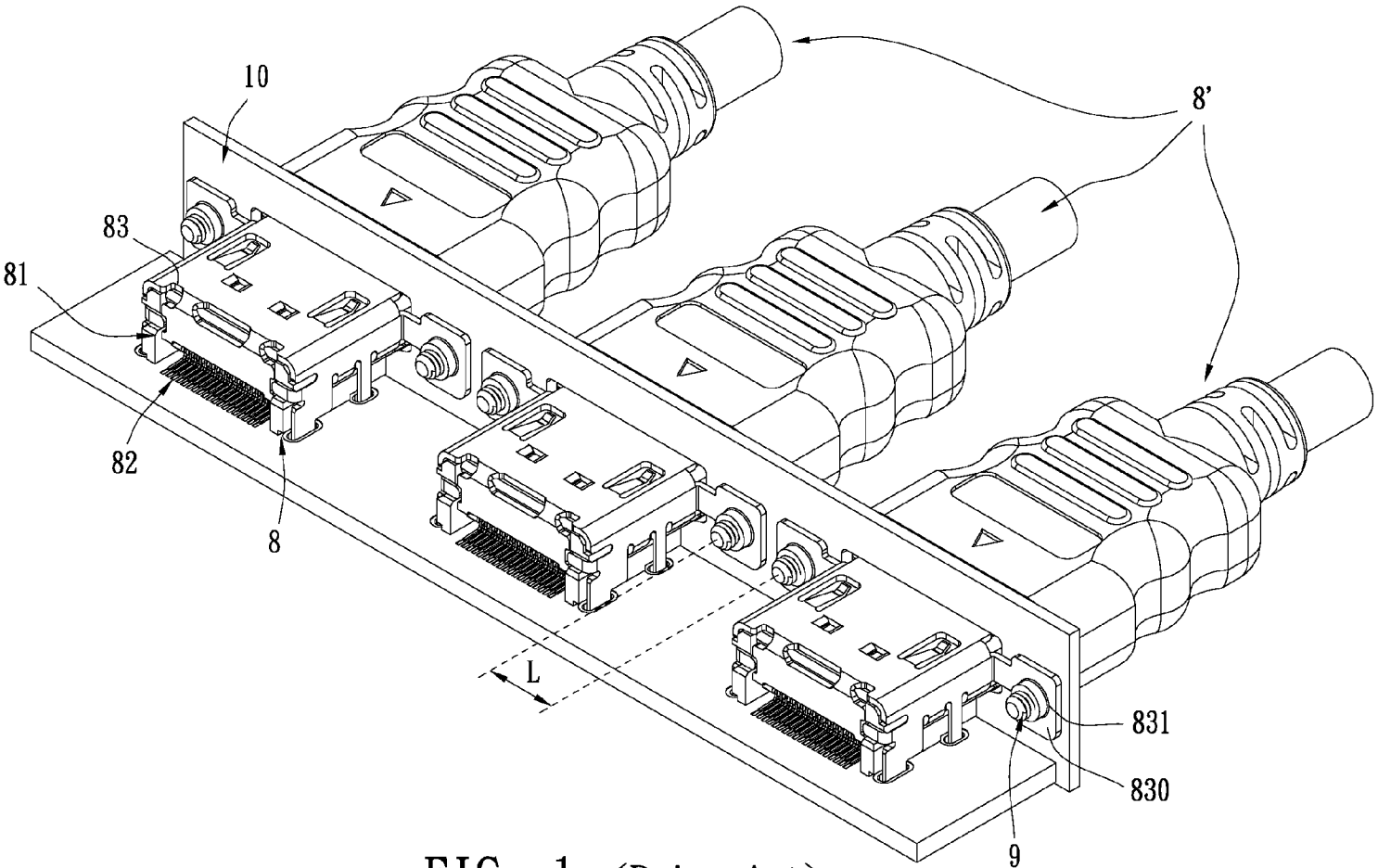
FIG. 1 (Prior Art)
FIG. 1 is a stereogram of the conventional electrical connectors disposed in a row.
Figure 2:
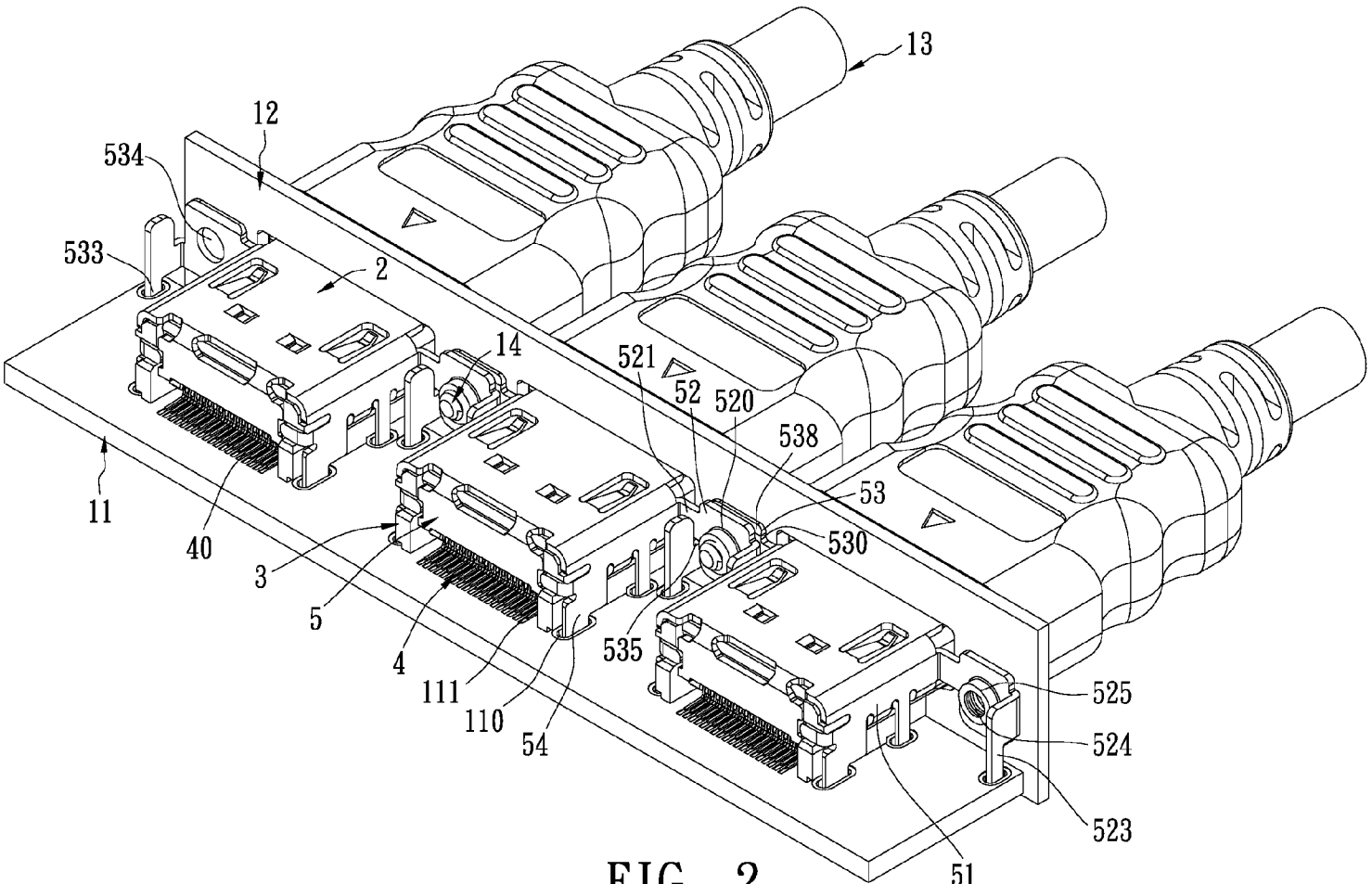
FIG. 2 is a stereogram illustrating a plurality of plugs connected to an assembly of a plurality of electrical connectors and a product cover on which the electrical connectors are mounted in accordance with an embodiment of the present invention.
Figure 3:
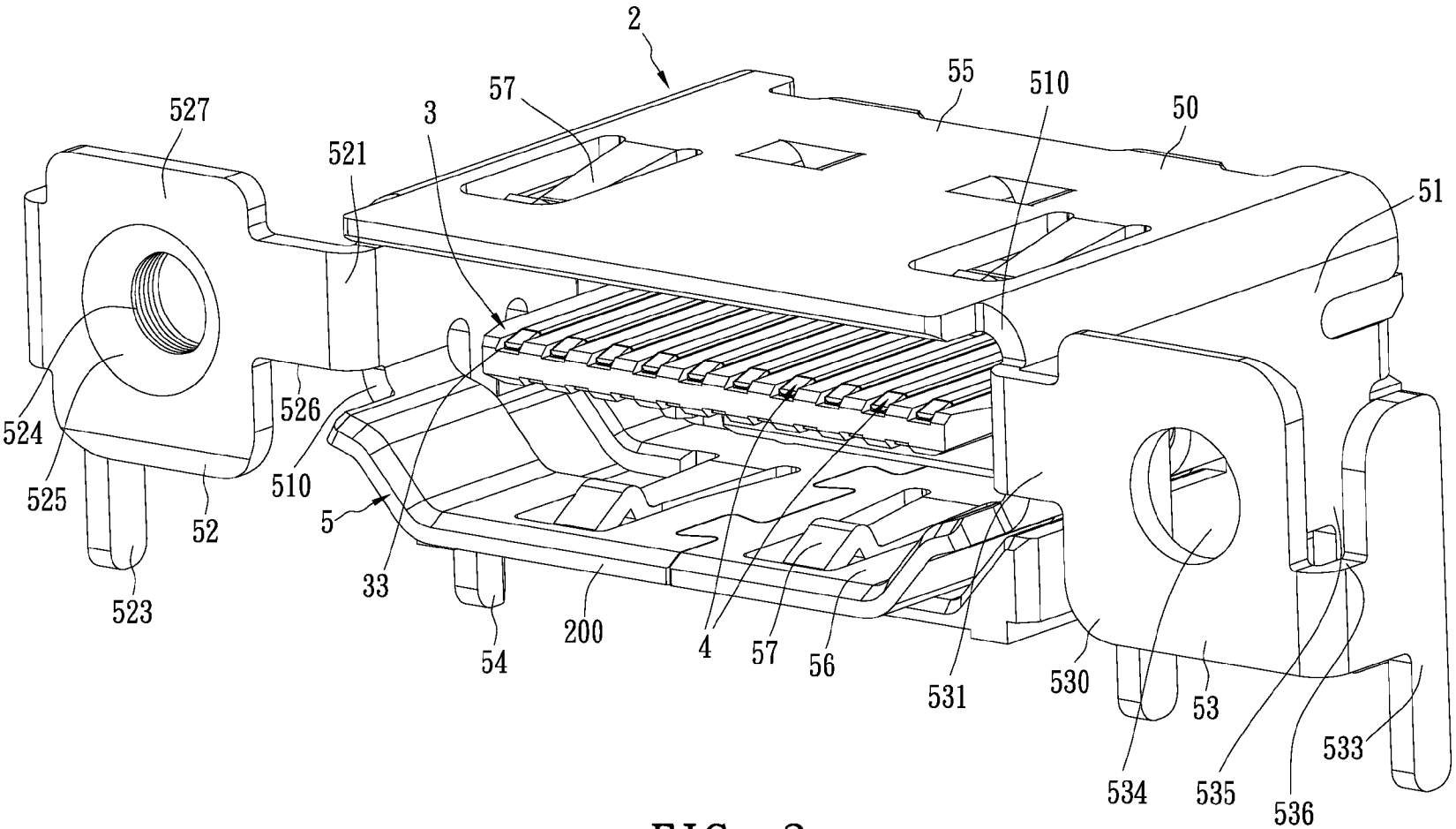
FIG. 3 is a stereogram of the electrical connector as shown in FIG. 2.
Figure 5:
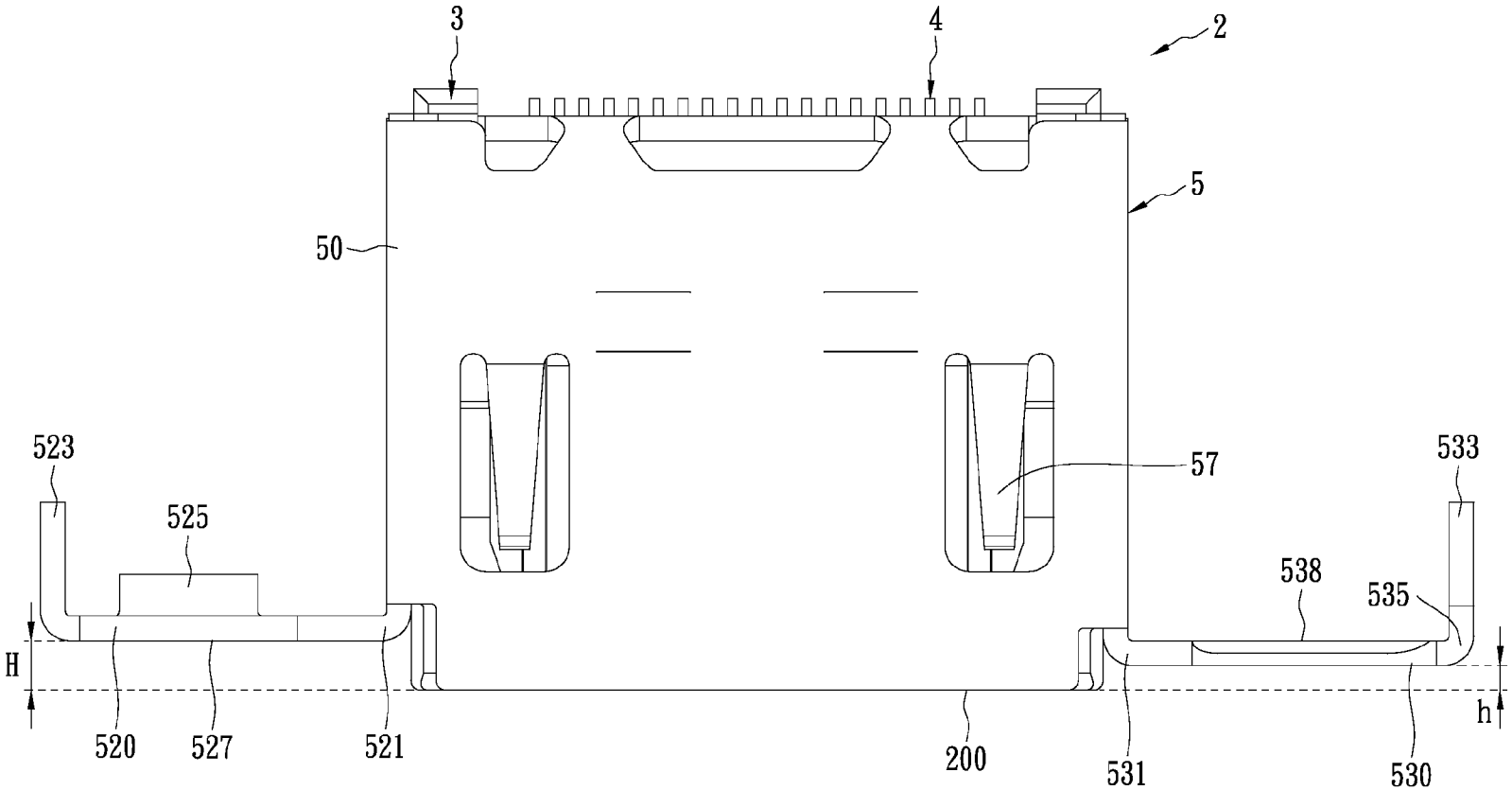
FIG. 5 is a top view of the electrical connector as shown in FIG. 2.

As shown in FIG. 2, electrical connectors 2 in accordance with an embodiment of the present invention are socket connectors, and they are disposed on the circuit board 11 of an electronic appliance (not shown) in a row. The electrical connectors 2 are further mounted on the shell 12 of the electronic appliance, and their insertion sides 200 are for corresponding plugs to be inserted into (as shown in FIGS. 3 and 5). For simplifying the following description, the side that the electrical connector 2 faces the circuit board 11 is defined as a lower side, and the opposite side is defined as an upper side; the insertion side 200 is defined as a front side, and the opposite side is defined as a rear side.

Figure 4:
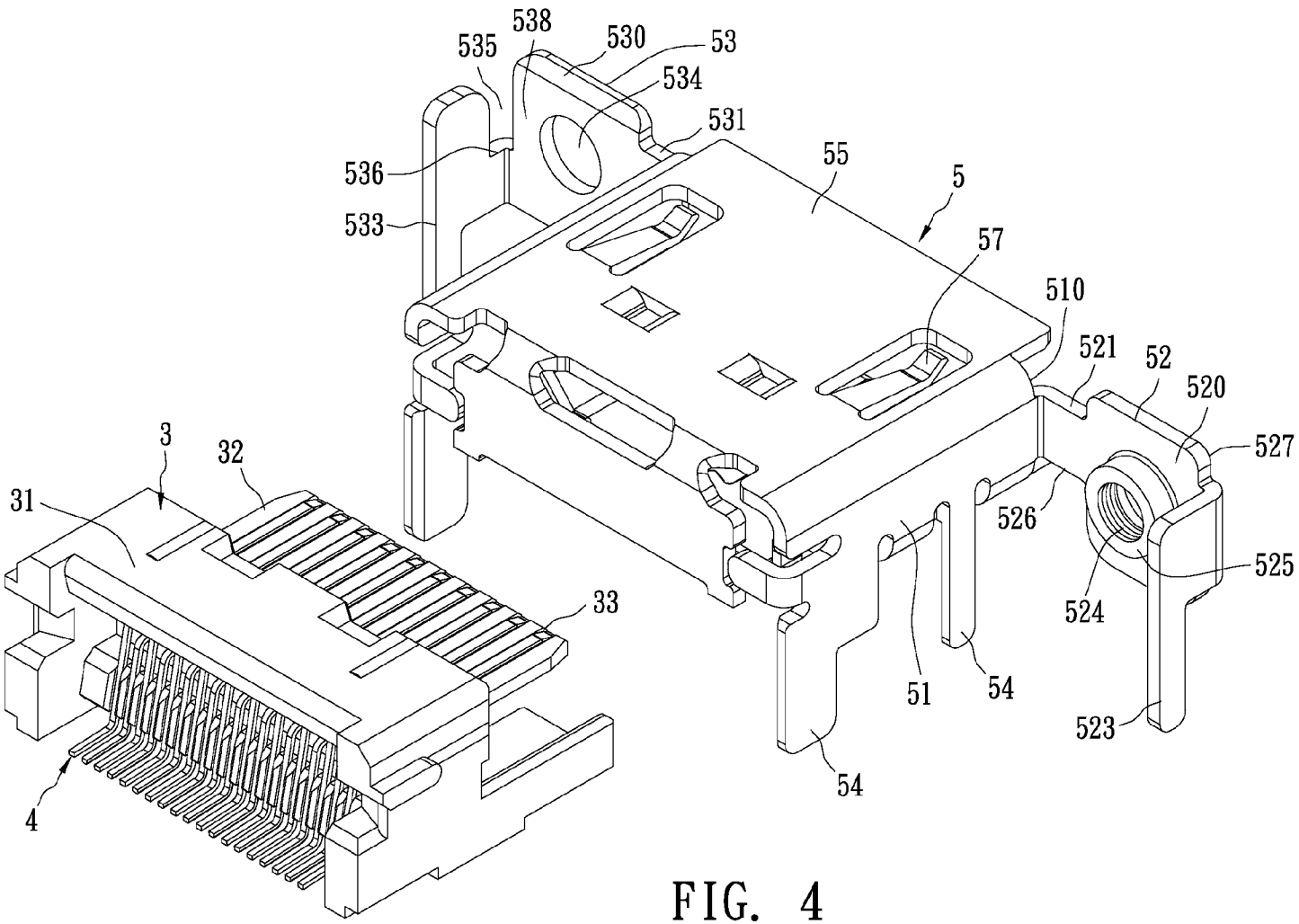
FIG. 4 is an exploded stereogram of the electrical connector as shown in FIG. 2.

Further in view of FIGS. 3, 4 and 5, each of the electrical connectors 2 comprises an insulation body 3, a plurality of conductive terminals 4 received in the insulation body 3, and a shielding shell 5 covering the insulation body 3. The insulation body 3 comprises a main body 31 and a tongue plate 32 connected to the main body 31 and horizontally extending from the main body 31 toward the front side. The tongue plate 32 comprises a plurality of receptacle grooves 33 for retaining the conductive terminals 4, and the receptacle grooves 33 further go through the main body 31 toward the rear side. The shielding shell 5 comprises an approximately rectangular frame 50. The frame 50 has two opposite side walls 51, and further has a top wall 55 and a bottom wall 56 connected to the side walls 51. The side walls 51, the top wall 55 and the bottom wall 56 respectively comprise front ends toward the plug 13. The front ends of the top wall 55 and the bottom wall 56 extend farther forward than the front surfaces of the side walls 51. In this embodiment, the plane of the insertion side 200 of the electrical connector 2 is defined by the front ends of the top wall 55 and the bottom wall 56. A first mounting portion 52 and a second mounting portion 53 are respectively disposed on the front ends of the side walls 51. The distance H between the first mounting portion 52 and the plane of the insertion side 200 is larger than the distance h between the second mounting portion 53 and the plane of the insertion side 200, as shown in FIG. 5.

The first mounting portion 52 and the second mounting portion 53 comprise sheet-like base portions 520 and 530, and further comprise connecting portions 521 and 531 which connect the base portions (520, 530) and the frame 50. The base portions 520 and 530 are respectively perpendicular to the side walls 51. Fixing holes 524 and 534 are respectively disposed on the base portions 520 and 530 for mounting the electrical connector 2. The first mounting portion 52 comprises a front surface 527, and the second mounting portion 53 comprises a rear surface 528. The front surface 527 and the rear surface 528 are at the same level. Through such surface arrangement, the first mounting portion 52 and the second mounting portion 53 between two adjacent electrical connectors 2 contact each other in a front-to-rear manner, and are fixed by a screw or a bolt.

In a preferable embodiment, the first mounting portion 52 further comprises a support foot 523 extending from the side edge of the base portion 520, vertically bent toward its rear side and going downwards. The support foot 523 improves the strength of the whole electrical connector 2. The fixing hole 524 of the base portion 520 further comprises a convex threaded portion 525 for being easily fixed.

The second mounting portion 53 comprises a support foot 533 bent from the side edge of the base portion 530 and extending backward. A fixing hole 534 passes through the base portion 530. A fastening slot 535 having an upper opening is between the base portion 530 of the second mounting portion 53 and its support foot 533 for assisting in mounting. The bottom edge 536 of the fastening slot 535 is lower than the bottom edge 526 of the connecting portion 521 of the first mounting portion 52 so that the connection portion 521 of the adjacent first mounting portion 52 can go across the fastening slot 535 to be fixed. In this way, an orientation objective for avoiding misuse is also achieved.

It should be noted that the inclusion of a foot is beneficial in general and if a foot included on both mounting portions, can provide significant structural improvements. A substantial portion of the structural improvement can also be obtained if a foot is included on only one of the mounting portions. Even without the use of the foot, however, the effective doubling up of the mounting portion substantially increases the structure integrity of the connectors when they are position in a row.

The shielding shell 5 comprises a plurality of fastening portions 54 extending downward from the frame 50. A plurality of soldering holes 110 are disposed on the corresponding positions of the circuit board 11. The fastening portions 54, the fixing foot 523 of the first mounting portion 52, and the fixing foot 533 of the second mounting portion 53 are inserted into the soldering holes 110 and are soldered together so that the electrical connector 2 is firmly mounted on the circuit board 11. There are a plurality of spring sheets for clipping disposed on the top wall 55 and bottom wall 56 of the shielding shell 5.

Figure 6:
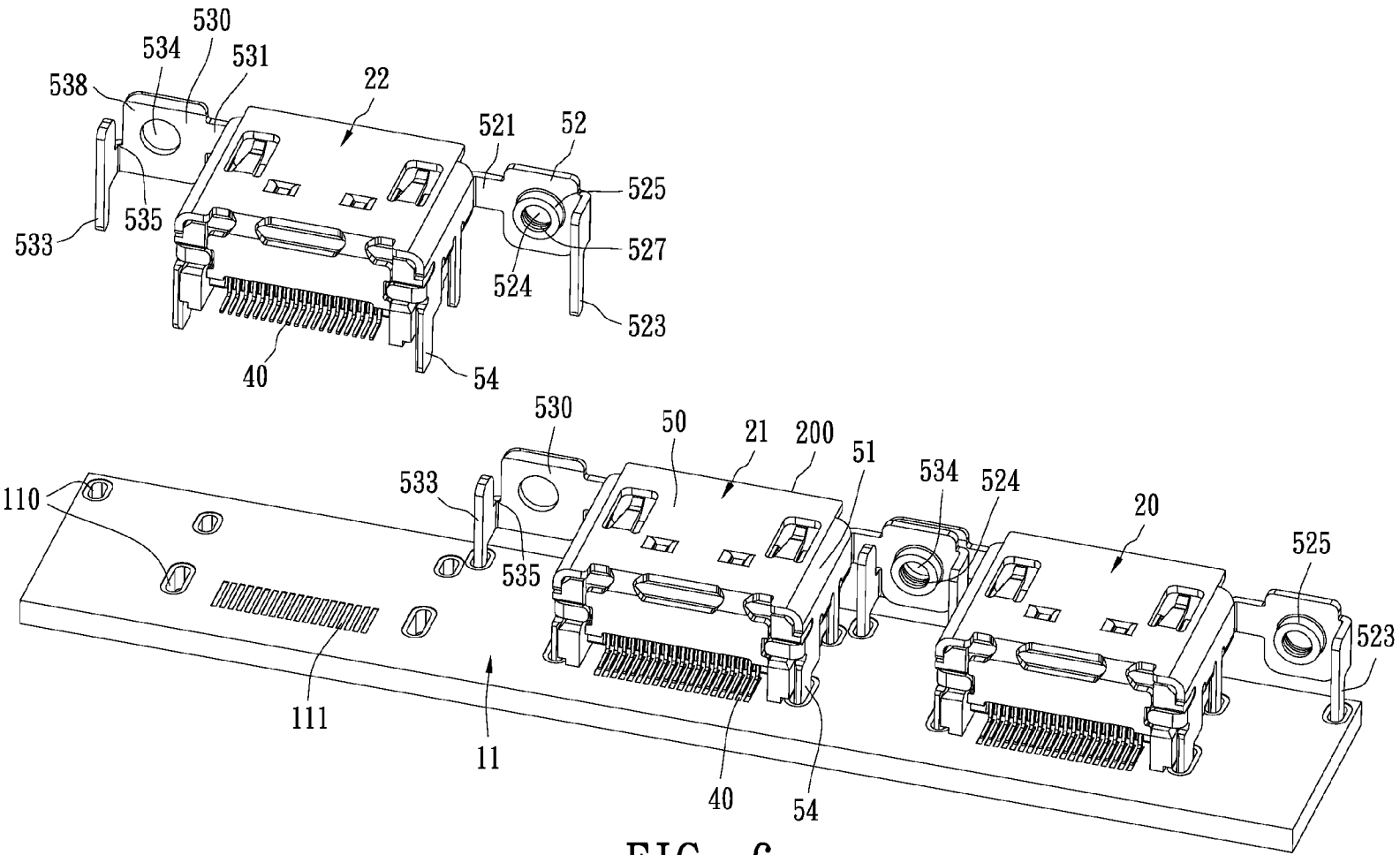
FIG. 6 is an exploded stereogram of a plurality of electrical connectors to be mounted in accordance with an embodiment of the present invention.
Figure 7:
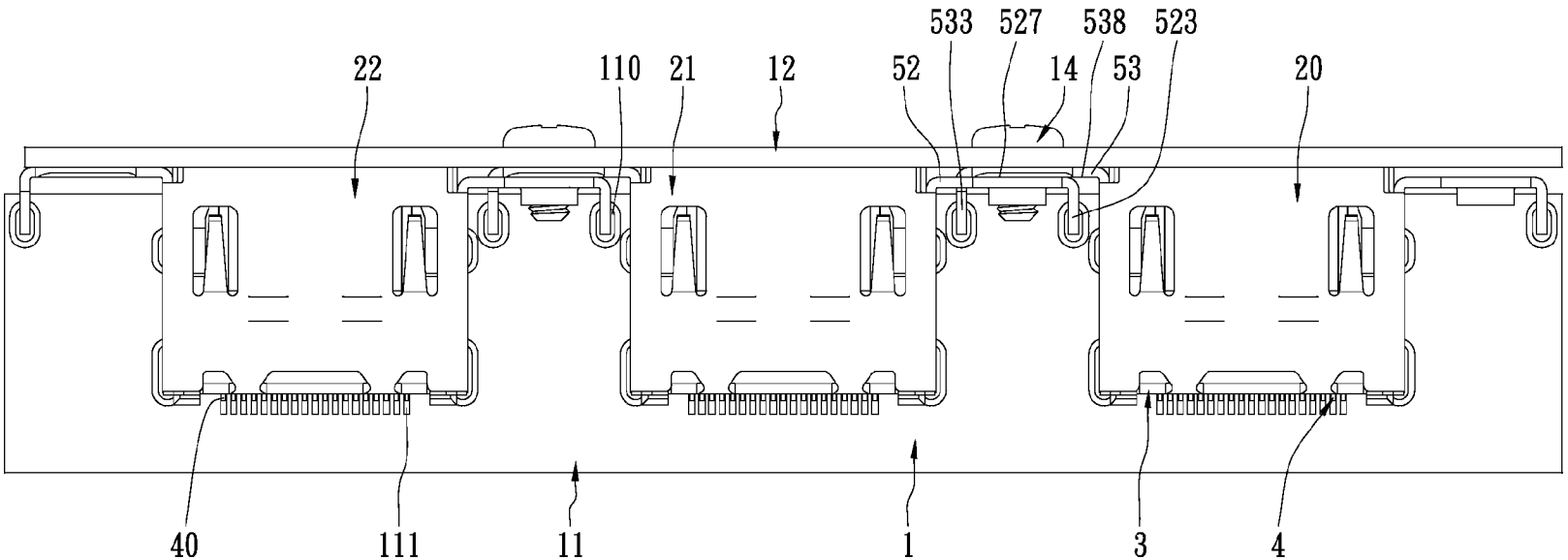
FIG. 7 is a top view of the plurality of electrical connectors mounted on the product cover as shown in FIG. 2.

In some applications, the number of the electrical connectors 2 can be increased so as to have more application interfaces on an electronic appliance. As shown in FIGS. 6 and 7, the preferable embodiment of the present invention utilizes three identical electrical connectors 20-22, and these connectors are connected to each other after being assembling together. As shown in FIG. 6, the electrical connectors 20 and 21 are mounted in predetermined positions on the circuit board 11. The soldering portion 40 of each of the conductive terminals 4 is placed on a corresponding soldering pad 111 disposed on the circuit board 11. The fastening portions 54, the fixing foot 523 of the first mounting portion 52, and the fixing foot 533 of the second mounting portion 53 are also placed on the corresponding soldering holes 110. Because the electrical connectors 20 and 21 have a special design, the distance between the first mounting portion 52 and the plane of the insertion side 200 is larger than the distance between the second mounting portion 53 and the plane of the insertion side 200. The front surface 527 of the first mounting portion 52 and the rear surface 538 of the second mounting portion 53 are on the same plane. Referring to FIG. 6, the front surface 527 of the first mounting portion 52 of the mounted electrical connector 21 and the rear surface 538 of the second mounting portion 53 of the mounted electrical connector 20 contact each other. The fixing holes (524, 534) sequentially pass through the two mounting portions (52, 53), and the insertion sides 200 of the connectors (20, 21) are also at the same level. In other words, the mounting portions (52, 53) of the two connectors (20, 21) intertwine when the connectors (20, 21) are positioned side-by-side. The connecting portion 521 of the first mounting portion 52 of the electrical connector 21 is retained in the fastening slot 535 of the second mounting portion 53 of the adjacent electrical connector 20, and they are interlocked. An electrical connector 22 is sequentially mounted to the left side of the electrical connector 21 to have an additional application interface. As shown in FIG. 7, similarly, the rear surface 538 of the second mounting portion 53 of the electrical connector 21 and the front surface 527 of the second mounting portion 53 of the mounted electrical connector 22 contact each other. Therefore, the electrical connectors 20, 21, and 22 are sequentially placed and mounted on the circuit board 11, and they are fixed on the circuit board 11 by soldering. A fastener 14 goes through the fixing holes 524 and 534 so as to stably mount the electrical connectors 20, 21, and 22 on the shell 12 of the product. In this embodiment, the fixing hole 524 includes a threaded portion 525 so that a screw or a bolt can be used to fasten the components. As shown in FIG. 7, the insertion sides 200 of the electrical connectors 20, 21 and 22 are at the same plane, and intervals between them are made as small as possible. The occupied space on the circuit board 11 is effectively reduced.

Figure 8:
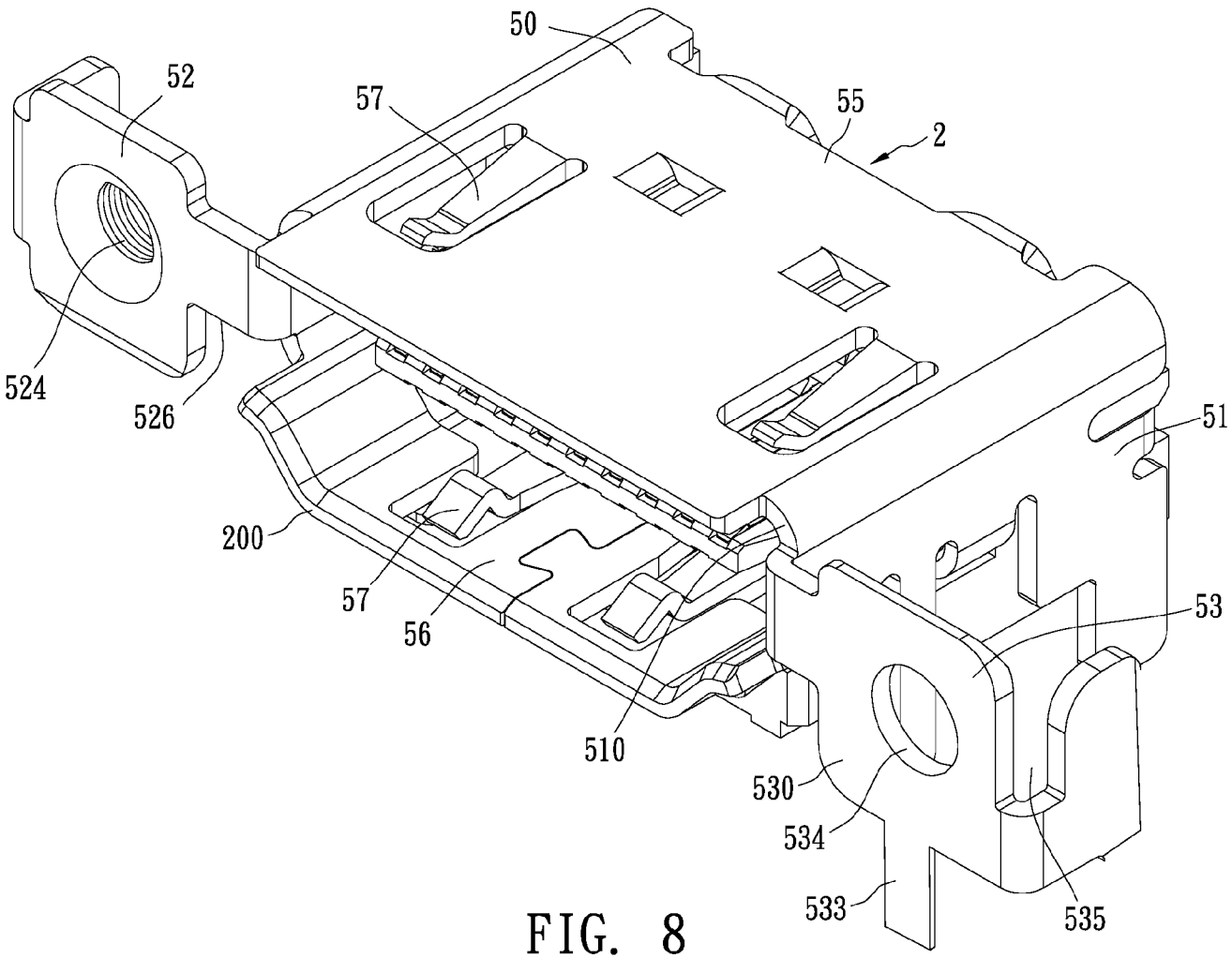
FIG. 8 is a stereogram of an electrical connector in accordance with another embodiment of the present invention.
Figure 9:
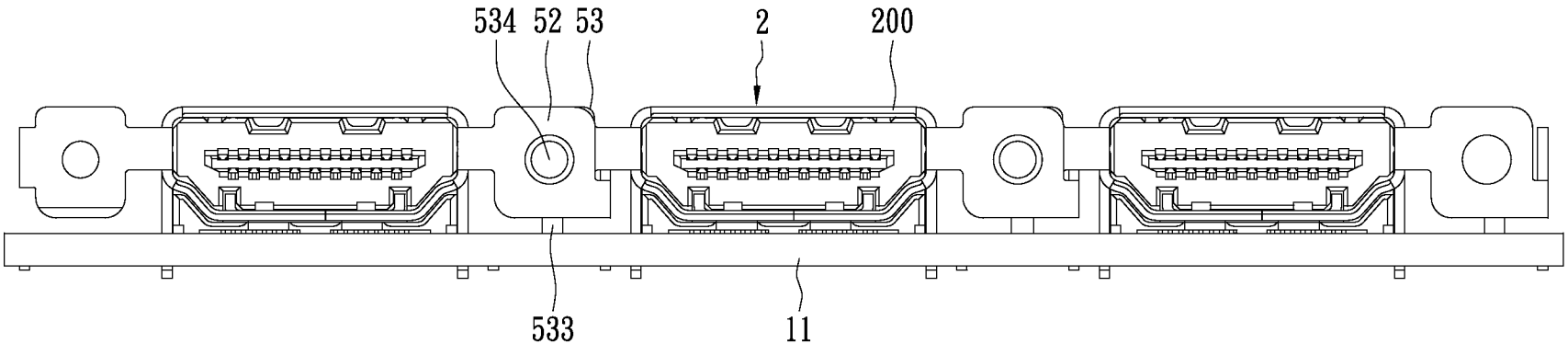
FIG. 9 is a stereogram of the plurality of electrical connectors as shown in FIG. 8 after being mounted.

The aforesaid embodiment of the present invention is merely a preferable embodiment, and any applications are not limited by the embodiment. The fixing feet (523, 533) of the first mounting portion 52 and the second mounting portion 53 of the electrical connector 2 can be relocated, or even can be eliminated. As shown in FIGS. 8 and 9, a fixing foot 533 extends downward directly from the middle of the base portion 530 of the second mounting portion 53 so that a stable objective is achieved and manufacturing cost is saved. The fixing holes of the first mounting portion 52 and the second mounting portion 53 can be of a different design, such as a screw hole which can be engaged with a screw. Alternatively, the fixing hole can be a through hole so that a rivet can be riveted therein or a bolt can go through to engage with a nut.

The present invention arranges the mounting portions on two sides of the electrical connector in different positions front-to-rear. Therefore, the fixing holes of the two adjacent electrical connectors are aligned with each other. The space occupied by the assembly of the electrical connectors can be reduced. Furthermore, the mounting portions of the electrical connector of the present invention have fixing feet which can equally resist action forces while being mounted to a printed circuit board by soldering. The present invention has a stably fixing result. It can meet the trend of miniaturized products because less space is required. The number of engaged parts of fasteners is reduced so that the manufacturing cost is reduced.

The above-described embodiments of the present invention are intended to be illustrative only. Numerous alternative embodiments may be devised by persons skilled in the art without departing from the scope of the following claims.

What is claimed is:

1. An electrical connector with an insertion side and a back side, comprising:

an insulation body;

a plurality of conductive terminals received in the insulation body; and a shielding shell covering the insulation body, the shell comprising:

a frame with front face on the insertion side, the front face aligned with an insertion plane, the frame including two opposite side walls a top wall and a bottom wall respectively connected to the side walls, wherein the plane of the insertion side is defined by front ends of the top wall and the bottom wall; and a first mounting portion with a first front surface and a second mounting portion with a second front surface, the first and second mounting portions respectively located on two sides of the frame, wherein a first distance between the first front surface and the insertion plane is larger than a second distance between the second front surface and the insertion plane, wherein the first mounting portion and the second mounting portion are respectively extended from the fronts of each of the side walls adjacent to the insertion side, and the first mounting portion has a first rear surface and the second mounting portion has a second rear surface, the rear surfaces being opposite the front surfaces and the second rear surface and the first front surface are at substantially the same distance from the insertion plan, wherein each of the first mounting portion and the second mounting portion has a fixing hole and the first mounting portion includes a threaded portion which protrudes through to the first rear surface.

2. The electrical connector of claim 1, wherein both the first mounting portion further comprises a first connecting portion extending from a front of the side wall and a base portion extending from the first connecting portion and the second mounting portion further comprises a second connecting portion extending from a front of the side walls and a second base portion extending from the second connecting portion, wherein the fixing holes are disposed on the first and second base portion.

3. The electrical connector of claim 2, wherein the first mounting portion further comprises a first support foot extending toward the back side from the first base portion and the second mounting portion further comprises a second support foot extending toward the back side from the second base portion, the first and second support foot configured in operation to engage a circuit board.

4. The electrical connector of claim 3, further comprising a fastening slot that includes an upward opening, the fastening slot positioned between the second base portion and the second support foot, wherein a top edge of the fastening slot is lower than a bottom edge of the first connecting portion.

5. An electrical connector, comprising:

a plurality of supported terminals each having a contact end and a circuit board mating end and body portion extending therebetween; and a shell forming a cage that at least partially encloses the terminals, the shell including a front opening aligned with an insertion plane and a back end and a first base portion and a second base portion both extending away from the front opening substantially parallel to the insertion plane and each including a fixing hole, the first and second base portion extending in opposite directions from the front opening, the first and second base portions positioned such that a front surface of the first base portion is aligned with a rear surface of the second base portion, wherein the fixing hole in the first base portion includes a threaded portion that extends from a rear surface of the base portion toward the back end.

6. The electrical connector of claim 5, wherein the first and second base portion are configured to intertwine when two such connectors are positioned side-by-side so that the fixing hole in the first base portion aligns with the fixing hole in the second base portion.

7. The electrical connector of claim 6, wherein at one of the first and second base portion includes a foot portion, the foot portion configured to engage a circuit board.

8. The electrical connector of claim 7, wherein the foot portion forms a plane that is substantially perpendicular to the insertion plane.

* * * * *